United States Patent [19]

Tanaka

[11] Patent Number: 4,526,433

[45] Date of Patent: Jul. 2, 1985

[54] CONNECTOR WITH A LOCKING MECHANISM

[75] Inventor: Masanori Tanaka, Osaka, Japan

[73] Assignee: Hosiden Electronics Co., Ltd., Japan

[21] Appl. No.: 541,919

[22] Filed: Oct. 14, 1983

[30] Foreign Application Priority Data

Oct. 20, 1982 [JP] Japan ..... 57-159958

[51] Int. Cl.[3] ..... H01R 13/639

[52] U.S. Cl. ..... 339/75 MP; 339/17 L; 339/80; 339/91 R; 339/108 R

[58] Field of Search ..... 339/91 R, 75 MP, 17 L, 339/17 LC, 176 MP, 17 LM, 74 R, 79, 80, 82, 339/84, 108 R, 75 R, 75 M

[56] References Cited

U.S. PATENT DOCUMENTS

| | | | |
|---|---|---|---|
| 3,140,907 | 7/1964 | Davies | 339/17 L |
| 3,829,821 | 8/1974 | Derr et al. | 339/91 R |
| 3,848,946 | 11/1974 | Halley et al. | 339/91 R X |
| 3,930,707 | 1/1976 | Venaleck et al. | 339/75 MP |
| 3,970,353 | 7/1976 | Kaufman | 339/91 R X |
| 4,018,495 | 4/1977 | Freitag | 339/75 MP X |

FOREIGN PATENT DOCUMENTS

| | | | |
|---|---|---|---|
| 1433439 | 2/1966 | France | 339/91 R |
| 1528076 | 4/1968 | France | 339/17 LC |

*Primary Examiner*—Gil Weidenfeld
*Assistant Examiner*—Steven C. Bishop
*Attorney, Agent, or Firm*—Steele, Gould & Fried

[57] ABSTRACT

A connector for an electronic part, having a locking mechanism comprising an engaging piece concealed interiorly of the connector and forming at least part of a conductive terminal in the connector, the engaging piece having an abutment for effecting a locking engagement with the electronic part and a catch for engagement with a special tool for releasing the locking engagement, the connector having a through hole formed in an outer wall thereof through which the tool may be inserted, and the engaging piece being adapted to permanently disrupt electrical contact between the electronic part and the connector part upon forced disconnection of the connector from the electronic part, whereby unauthorized disconnection renders at least one of the connector and the electronic part unusable. In a preferred embodiment, in which the engaging piece forms all or part of a conductive terminal in the connector, the engaging piece is adapted to either destroy a conductive path formed on the electronic part upon forceable separation, or is adapted to break upon forceable separation.

8 Claims, 6 Drawing Figures

3
31
31a
31b
1
1a
1b
1c
1d
1e
2"
2'b
2'c
2'd
4
2'''
2'''b
2'''c
2'''d
2'''e
1'''e

CONNECTOR WITH A LOCKING MECHANISM

BACKGROUND OF THE INVENTION

1. Field of the Invention

This invention relates to improvements in a connector designed to lock plug-in connection of electronic part, and more particularly to a novel connector with a locking mechanism which can be unlocked only by use of a special tool or jig.

2. Prior Art

Connectors with a locking mechanism are well known. Since these conventional connectors are of the construction in which users can understand how to unlock the connectors from outside, users can readily unlock the connectors where necessary. Therefore, in a view of prevention of possible danger and/or illicit use, it was impractical to use the connectors of the type described above at places where users have easy access to them.

SUMMARY OF THE INVENTION

Accordingly, it is primary object to provide a connector with a locking mechanism which permits disconnection only by an authorized person. This object of the invention can be achieved by a connector for an electronic part, having a locking mechanism comprising an engaging piece concealed interiorly of the connector and forming at least part of a conductive terminal in the connector, the engaging piece having an abutment for effecting a locking engagement with the electronic part and a catch for engagement with a special tool for releasing the locking engagement, the connector having a through hole formed in an outer wall thereof through which the tool may be inserted, and the engaging piece having means for permanently disrupting electrical contact between the electronic part and the connector upon forced disconnection of the connector from the electronic part, whereby unauthorized disconnection renders at least one of the connector and the electronic part unusable. In a particularly preferred embodiment, the engaging piece forms all or part of a conductive terminal for the connector. In one form of the preferred embodiment, the engaging piece comprises a locking pawl adapted to engage in a corresponding hole formed in the electronic part. In another form, the engaging piece has a locking hole formed therein adapted to engage a corresponding projection formed in the electronic part. The engaging piece may comprise a contact-making portion adapted to pressably engage a conductive pattern formed on the electronic part, the contact-making portion being adapted to break off from the engaging piece upon forceable separation of the connector from the electronic part. Alternatively, the engaging piece may comprise a sharp portion adapted to destructively engage a conductive path formed on the electronic part upon forceable separation of the connector from the electronic part. In all embodiments, unauthorized disconnection will be significantly discouraged.

DETAILED DESCRIPTION OF THE PREFERRED EMBODIMENTS

Figure 1:
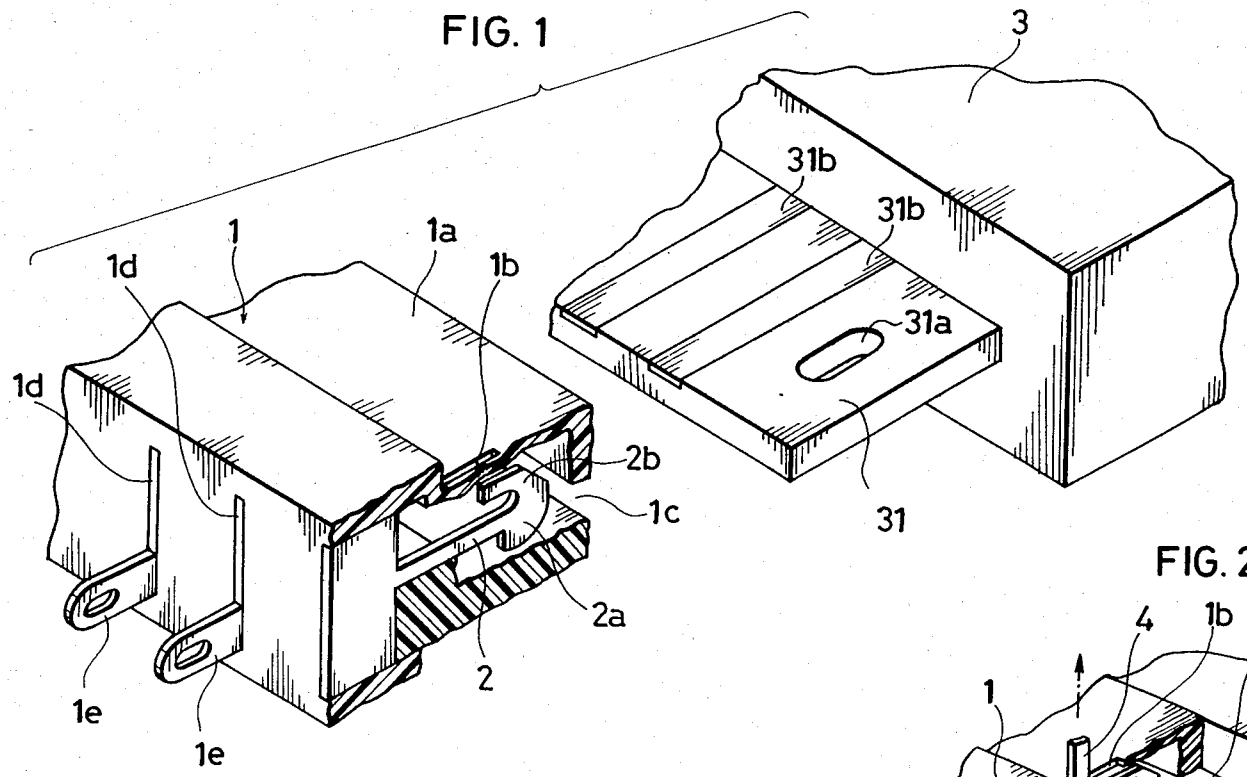
FIG. 1 is a perspective view, broken in part, of one embodiment of a locking mechanism according to the invention.

A description will now be given of preferred embodiments of the invention with reference to the accompanying drawings. FIG. 1 shows a body 1 of a connector having an engaging piece 2 concealed on both sides (one side alone shown) of the body 1. The body 1 has a fitting groove 1*c* formed in the front portion of the body 1. A leg portion 31 of an electronic part 3 such as an IC cartridge (IC package) is insertable into the groove 1*c* so as to permit the connection of the part 3 with the body 1 in one operation.

Figure 2:
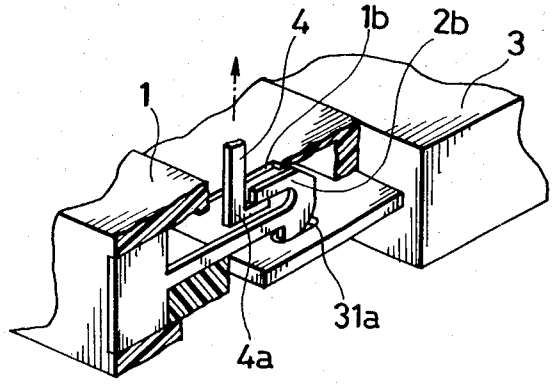
FIG. 2 is a view illustrating the unlocking operation of the locking mechanism of the embodiment in FIG. 1.

When the electronic part 3 is inserted into and connected with the body 1, the leg 31 of the part 3 is readily inserted into the body 1 by the elastic deformation of engaging piece 2. Upon completion of insertion, a locking pawl 2*a* of the piece 2 is disposed in an engaging hole 31*a* formed in the leg 31 of the part 3 to bring the hole and the pawl into locked state connection. The body 1 and the part 3 are unlocked as soon as the part 3 is drawn out from the body by a tool or jig 4 having a hook-shaped front end 4*a* being inserted through a hole 1*b* formed in the outer wall 1*a* (an upper cover in FIG. 1) of the connector body 1. The end portion 4*a* of the tool 4 catches the hook portion 2*b* of the engaging piece 2 to raise the hook portion 2*b* upwardly, while at the same time withdrawing part 3, as shown in FIG. 2. Once the body 1 and the part 3 have been connected, the engaging portion 2 held in the connector constituting the locking mechanism and the engaging hole 31*a* formed in the part 3 are concealed from outside the connector so that users cannot determine the manner of unlocking the connector.

In the drawing, the numerals 31*b* designate conductive patterns formed in the leg portion 31 of the electronic part 3, and when the body 1 and the part 3 are connected, the patterns come into contact with conductive terminals 1*e* in the connector body 1 to electrically connect terminals 1*e* with patterns 31*b*.

Figure 3:
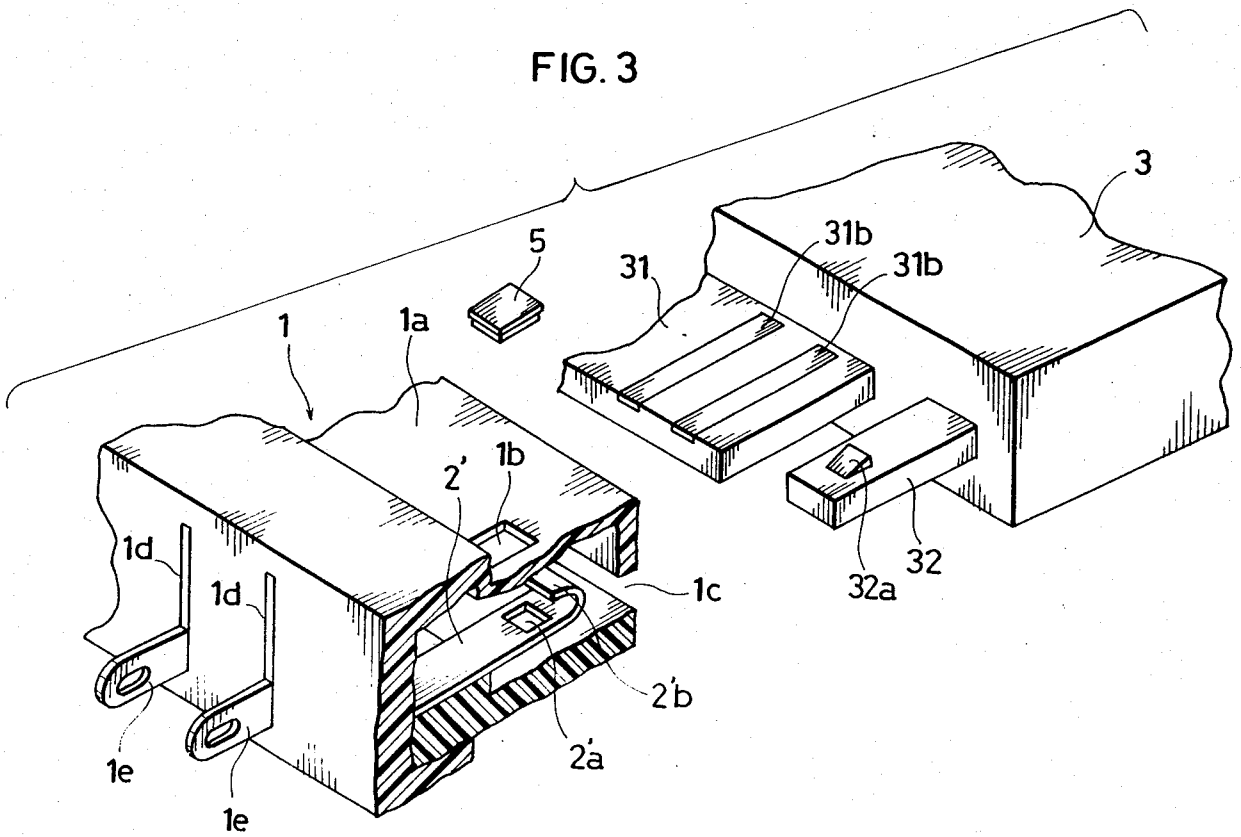
FIG. 3 is a perspective view, broken in part, of another embodiment of the locking mechanism according to the invention.

FIG. 3 shows another embodiment of the invention illustrating a modification of the locking mechanism. The modified locking mechanism has a locking hole 2*a*′ formed in an engaging piece 2′ and has an engaging projecting piece 32 formed on the electronic part 3 side and having an engaging projection 32*a* formed therein. The engaging projection 32*a* of the engaging projecting piece 32 formed on the part 3 side is formed with a tapered surface. The tapered surface has an angle at which the engaging projection 32*a* is gradually increasing in thickness along the direction of insertion of the part 3 for facilitating the insertion of the part 3 into the body 1. A cap 5 is detachably fitted in the through hole 1*b* formed in the outer wall surface 1*a* of the connector body 1 so as to protect the inside of the body against dust or dirt infiltration. Disconnection of the part 3 from the body 1 is made by taking off the cap 5 and inserting a tool into the through hole 1*b* in the manner described with reference to the first embodiment of the invention. Although not shown, forced disconnection of the part 3 from the body 1 leads to damage of the leg portion 31 or engaging projecting piece 32 of the part 3, making replacement of other electronic parts impossible. Accordingly, it is especailly desirable to construct the connector wherein the users find it impossible to draw out the part 3 from the connector body.

Figures 4, 5, 6:
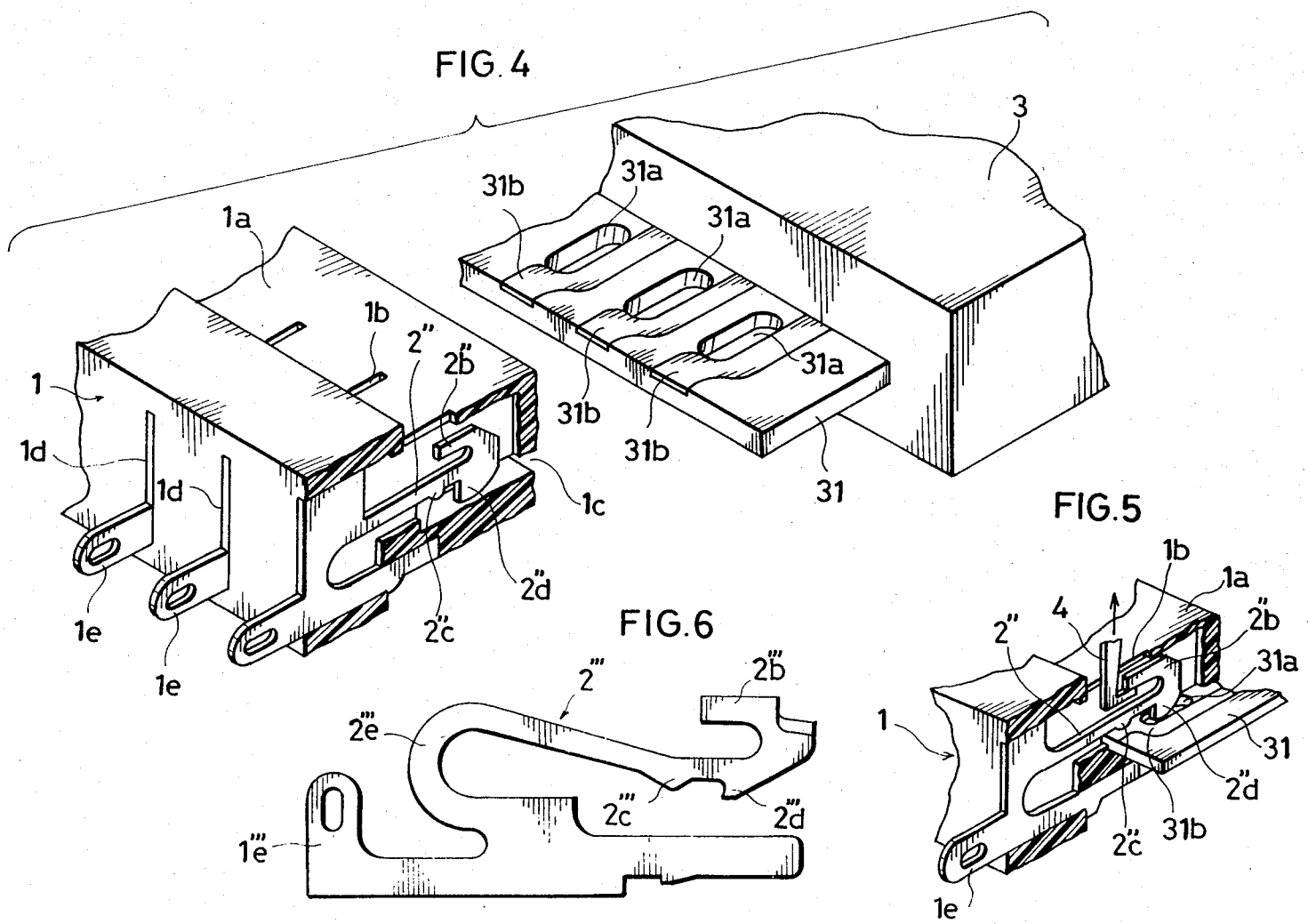
FIG. 4 is a perspective view, broken in part, of still another embodiment of the locking mechanism according to the invention.
FIG. 5 is a view illustrating the unlocking operation of the locking mechanism of the embodiment in FIG. 4; and, FIG. 6 shows another embodiment of an engaging piece.

FIG. 4 shows still another embodiment of the invention wherein the conductive terminal of the body 1 is formed with an engaging piece 2″ which constitutes one component of the locking mechanism. In this embodiment, the conductive terminal of the connector can be used also as a locking mechanism.

In this embodiment also, the engaging piece is of the construction in which the piece is concealed inside the connector body 1 such that, as shown in FIG. 5, the locking mechanism is unlocked by insertion of a tool 4 into the through hole 1*b* formed in the outer wall 1*a*. In this respect, the embodiment is the same as the two foregoing embodiments, but the conductive terminal serving concurrently as the engaging piece 2″ has a contact-maker 2″*c* coming into conductive contact with the conductive patterns 31*b* formed in the leg portion 31 of the part 3 and is so designed that forced drawing of the part 3 from the connector body 1 makes it impossible to reuse the connector by breaking off the conductive patterns 31*b* by the cutout pawl 2″*d* formed in the lower portion of the engaging piece 2″.

The engaging piece may also be used in the form shown in FIG. 6 in addition to the embodiments shown above. Namely, the engaging piece 2‴ has a curved neck portion 2‴*e* and is constructed such that, when an engaging piece 2‴ is vertically moved by the piece 2‴ being caught by a tool (not shown) to make the piece 2‴ engage in and disengage from an engaging hole 31*a*, the elasticity of the neck portion 2‴*e* is utilized to make the piece 2‴ resistant to destructive deformation during movement. Accordingly, an engaging piece free from danger of breakage and high in durability can be obtained despite frequent engagement and disengagement of the piece 2‴.

In the drawing, the numerals 2‴*c* and 2‴*d* designate a contact-maker and a cutout pawl, respectively and 1‴*e* designates a conductive terminal.

When the connector of the invention is produced in accordance with the embodiments described above, it is highly useful to use such a means in the conductive patterns corresponding to the locking means as the one in which damage of a given portion like a power supply terminal makes the connector assembly electrically inoperative.

Terminals 1*e* projecting from longitudinal slits 1*d* formed on the rear side of the connector body 1 are conductive terminals provided on the connector body 1 corresponding to the conductive patterns 31*b* on the electronic part 3.

As shown in the foregoing embodiments, the connector assembly of the invention conceals the components of its locking mechanism inside the connector body 1, with the result that not only the mechanism cannot be seen from outside but also unlocking of the locking mechanism to draw out the electronic part 3 from the connector body 1 can be effected only by the engaging piece operated by insertion of a tool through the hole of the connector in the outer wall of the connector body. Accordingly, the connector makes it possible for the users to disconnect the part 3 from the connector body, while on the other hand only those dealers specialized in the art can draw out and replace the part 3 in maintenance and like operations. Such being the fact, the connector of the invention is very useful as a connector adapted for prevention of illicit use through the replacement of electronic parts such as a ROM cartridge which is bound to be attached to a radio apparatus or such as a connector for prevention of danger, and can find new and increased application in place of conventional connectors.

It should be understood that the connector of the invention is not limited to the embodiments illustrated but various changes and modifications may be made without departing from the spirit and scope of the invention. For example, various modifications may be made in the shape of the engaging piece and in the position of the through hole.

Also, the electronic parts are not limited to IC packages alone but may be applicable to all the parts electrically connectable to the connector, for example, in such a manner that connectors may be connected to each other.

What is claimed is:

1. A connector for an electronic part, having a locking mechanism comprising an engaging piece concealed interiorly of the connector and forming at least part of a conductive terminal in the connector, the engaging piece having a abutment for effecting a locking engagement with the electronic part and a catch for engagement with a special tool for releasing the locking engagement, the connector having a through hole formed in an outer wall thereof through which the tool may be inserted, and the engaging piece having means for permanently disrupting electrical contact between the electronic part and the connector upon forced disconnection of the connector from the electronic part, whereby unauthorized disconnection renders at least one of the connector and the electronic part unusable.

2. A connector according to claim 1, wherein the engaging piece comprises an elastic portion which facilitates connection and authorized disconnection of the connector and the electronic part.

3. A connector according to claim 1, wherein the engaging piece forms all of the conductive terminal.

4. A connector according to claim 1, wherein the engaging piece comprises a locking pawl adapted to engage in a corresponding hole formed in the electronic part.

5. A connector according to claim 1, wherein the engaging piece has a locking hole formed therein adapted to engage a corresponding projection formed in the electronic part.

6. A connector according to claim 1, wherein the engaging piece comprises a contact-making portion adapted to pressably engage a conductive pattern formed on the electronic part.

7. A connector according to claim 1, wherein the engaging piece comprises a sharp portion adapted to destructively engage a conductive path formed on the electronic part upon forceable separation of the connector from the electronic part.

8. A connector according to claim 6, wherein the contact-making portion is adapted to break off from the engaging piece upon forceable separation of the connector from the electronic part.

* * * * *